US007828609B2

(12) United States Patent
Li et al.

(10) Patent No.: US 7,828,609 B2
(45) Date of Patent: Nov. 9, 2010

(54) LINE SPRING JACK AND ITS ASSEMBLY METHOD

(75) Inventors: Zhan Li, Shenzhen (CN); Yuan Ye, Shenzhen (CN); Chen Ning, Shenzhen (CN)

(73) Assignee: BYD Company Ltd., Shenzhen (CN)

( * ) Notice: Subject to any disclaimer, the term of this patent is extended or adjusted under 35 U.S.C. 154(b) by 0 days.

(21) Appl. No.: 12/472,313

(22) Filed: May 26, 2009

(65) Prior Publication Data

US 2009/0298356 A1 Dec. 3, 2009

(30) Foreign Application Priority Data

May 30, 2008 (CN) ..... 2008 1 0108661
Feb. 27, 2009 (CN) ..... 2009 1 0105668

(51) Int. Cl.
*H01R 13/06* (2006.01)

(52) U.S. Cl. ..... 439/843; 439/847; 29/874; 29/876; 29/862

(58) Field of Classification Search ..... 439/843, 439/847; 29/874, 876, 882, 862
See application file for complete search history.

(56) References Cited

U.S. PATENT DOCUMENTS 4,087,152 A * 5/1978 Kolm ..... 439/827
4,693,002 A * 9/1987 Neumann et al. ..... 29/882
5,203,813 A * 4/1993 Fitzsimmons et al. ..... 29/876
6,102,746 A * 8/2000 Nania et al. ..... 439/675
6,273,766 B1 * 8/2001 Zennamo et al. ..... 439/843
6,767,260 B2 * 7/2004 Beloritsky et al. ..... 439/843
7,191,518 B2 * 3/2007 Beloritsky et al. ..... 29/874
7,311,566 B2 * 12/2007 Dent ..... 439/843

FOREIGN PATENT DOCUMENTS

| | | |
|---|---|---|
| CN | 2617051 | 5/2004 |
| CN | 2718807 | 8/2005 |
| JP | 5135818 | 6/1993 |
| JP | 10041003 | 2/1998 |

OTHER PUBLICATIONS

International Search Report and Written Opinion for International Application No. PCT/CN2009/000608, mailed Sep. 3, 2009, 9 pages.

* cited by examiner

*Primary Examiner*—Gary F. Paumen
(74) *Attorney, Agent, or Firm*—Morgan, Lewis & Bockius LLP

(57) ABSTRACT

A line spring jack and an assembling method are disclosed. The line spring jack comprises a jack body, a jack cap, a line spring wire and a positioning plug. Said jack body further comprises a plug hole; said line spring wire is located in said plug hole; said jack cap is connected to one end of said jack body; said jack cap further comprises a through hole connected to said plug hole; one end of line spring wire is clipped in a space formed between said jack cap and said jack body; wherein said plug hole further comprises a groove in the bottom; the caliber of the groove is smaller than the diameter of said plug hole; said positioning plug includes a part in the groove and a part in the plug hole, the part in the groove is tightly matched to said groove.

16 Claims, 6 Drawing Sheets

LINE SPRING JACK AND ITS ASSEMBLY METHOD

CROSS-REFERENCE TO RELATED APPLICATION

This application claims priority to and benefit of Chinese Patent Application Serial No. 200810108661.0, filed in the State Intellectual Property Office of the P. R. China on May 30, 2008, and the Chinese Patent Application Serial 200910105668.1, filed in the State Intellectual Property Office of the P. R. China on Feb. 27, 2009, the entire contents of which are incorporated herein by reference.

BACKGROUND OF THE INVENTION

1. Field of the Invention

The present invention relates to a line spring jack and an assembly method.

2. Background of the Related Art

A connector is an important device in the field of industrial electrical equipment and charging electric automobile. The key part of a connector is a metal clip terminal. As the key part of current conducting, the requirement of its insertion-withdrawal force, insertion-withdrawal frequencies and contact resistance is very high.

The combination of a line spring jack and a plug stud is one type of a metal clip terminal. The plug stud which matches the line spring jack is inserted into the line spring jack to contact with the wire of the line spring jack, thus results in an electric contact. The current line spring jack comprises a jack body, a jack cap, a line spring wire and a positioning plug. The line spring wire is located in a hole of the jack body; one end of the jack body extends out of the hole and bends outwards to catch the outer surface of the jack body. The jack cap is jacketed to the jack body. Said hole further comprises a groove in the bottom of the jack body, wherein the diameter of the groove is larger than the diameter of the jack body. The positioning plug is put into said groove, so that another end of the line spring wire is fixed between the positioning plug and the sidewall of the groove.

Although the positioning plug is used in the line spring jack described above, because the diameter of said groove is larger than the diameter of the jack body, the external diameter of the positioning plug is larger than the diameter of said groove. To assemble the positioning plug into said groove, the positioning plug is required to be stamped and thus enlarges the hole. Therefore, the hole enlarging equipment and process are required. Meanwhile, the assembly of putting the positioning plug into the groove may be more difficulty.

SUMMARY OF THE INVENTION

The present invention discloses a line spring jack and its assembly method.

According to an embodiment of the invention, a line spring jack comprises a jack body having an open end and a closed end and a plug hole therein between the open end and the closed end, a jack cap connected to the open end of the jack body, one or more line spring wires within the plug hole and a positioning plug. The plug hole may further include a groove near the closed end of the jack body, the diameter of the groove may be smaller than the diameter of the rest of the plug hole. The jack cap may further include a through hole via which the plug hole may be exposed externally. And the positioning plug may comprise a first portion within the groove and a second portion within the rest of the plug hole.

The first portion within the groove may be configured to tightly fit the groove. A first end of at least one of the one or more line spring wires may be located within a space defined between an interior surface of the jack cap and an exterior surface of the jack body. And a second end of the at least one line spring wire is located within a space defined between an exterior surface of the second portion of the plug hole and an interior surface of the jack body.

In some embodiment, said jack body further comprises at least two fixing grooves ranked in the brim of the jack body with certain distance in between; said line spring wire is located in the fixing grooves; one end of said line spring wire extending out the fixing grooves is clipped in a space between said jack cap and said jack body.

According to an embodiment of the invention, a method of assembling a line spring jack is disclosed. The method comprises the steps of: providing a jack body, a jack cap, one or more ling spring wires, and a positioning plug, in which the jack body comprises an open end and a closed end and a plug hole therein between the open end and the closed end, the plug hole further including a groove near the closed end of the jack body, the diameter of the groove may be smaller than the diameter of the rest of the plug hole; and the jack cap may further include a through hole via which the plug hole is exposed externally; placing the one or more line spring wires in the plug hole of the jack body; placing a first portion of the positioning plug within the groove and a second potion of the positioning plug within the rest of the plug hole; fixing the jack cap to the jack body near the open end such that a first end of the one or more line spring wires is located within a space between an interior surface of the jack cap and an exterior surface of the jack body; and placing a second end of the one or more line spring wires between an exterior surface of the second portion of the positioning plug located within the plug hole and an interior surface of the jack body.

In some embodiment of the assembly method of present invention, the line spring wire may be fixed in the fixing grooves of said jack body brim. One end of said line spring wire is in the space between part of the positioning plug in the plug hole and the interior surface of said jack body; said line spring wire can move in the space by an outside force.

BRIEF DESCRIPTION OF THE DRAWINGS

The aforementioned features and advantages of the invention as well as additional features and advantages thereof will be more clearly understood hereinafter as a result of a detailed description of embodiments when taken in conjunction with the drawings.

DESCRIPTION OF THE EMBODIMENT

The aforementioned features and advantages of the invention as well as additional features and advantages thereof will be more clearly understood hereinafter as a result of a detailed description of the following embodiments when taken in conjunction with the drawings.

Figure 1:
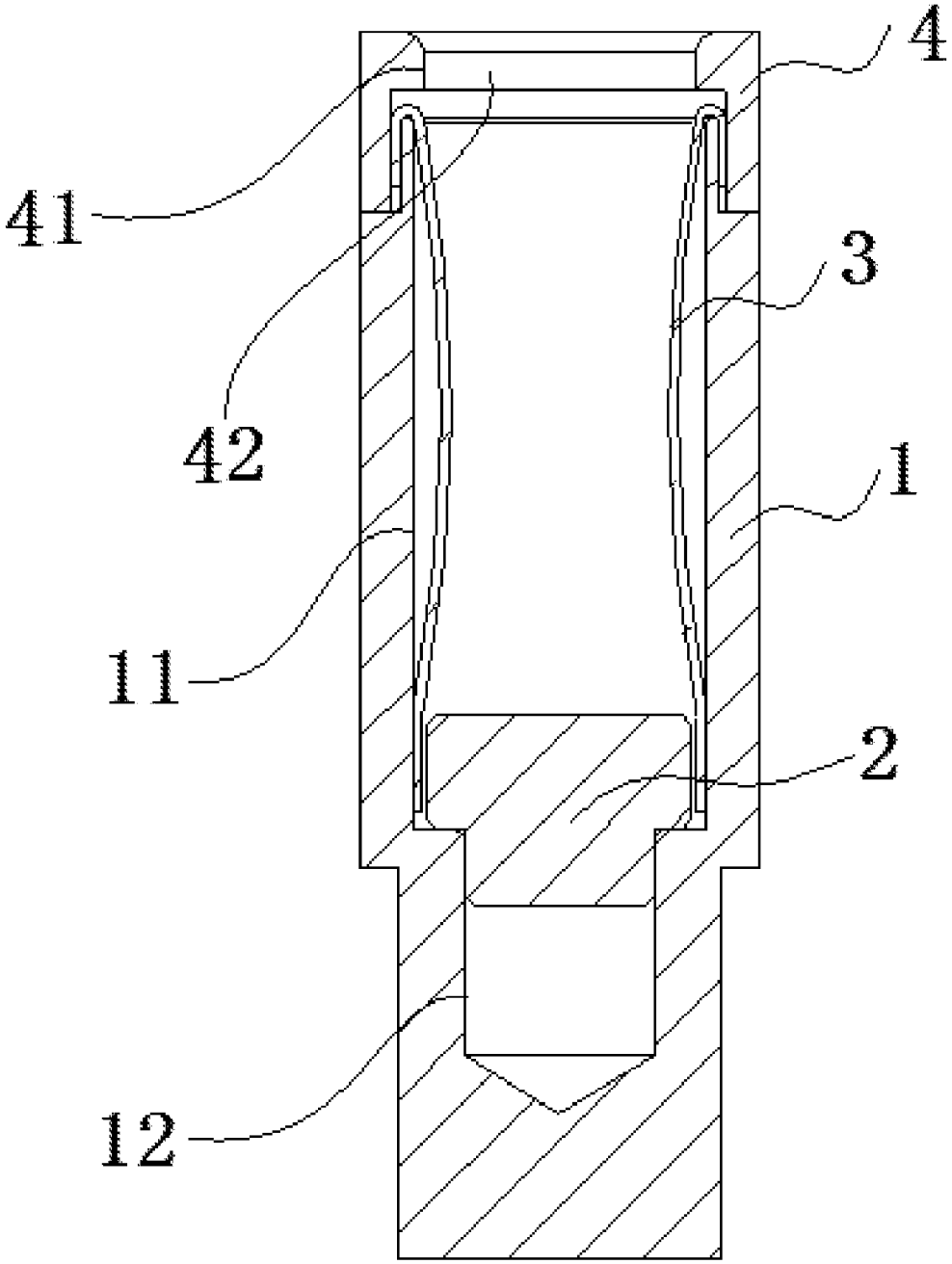
FIG. 1 shows a schematic cross sectional view of a line spring jack according to an embodiment of the invention.

As shown in FIG. 1, one embodiment of the present invention provides a line spring jack. The line spring jack comprising: a jack body 1, a jack cap 4, one or more line spring wire 3 and a positioning plug 2; said jack body 1 further comprises an open end, a closed end and a plug hole 11 therein between the open end and the closed end; said line spring wire 3 is located in the plug hole 11 of said jack body 1; said jack cap 4 is tightly connected to one end of the jack body 1; said jack cap 4 further comprises a through hole 42 which is communicated with said plug hole 11; one end of the line spring wire 3 may be located within a space defined between an interior surface of the jack cap 4 and an exterior surface of the jack body 1. In an embodiment of the invention, one end of the line spring wire 3 is clipped in a space formed between said jack body 1 and jack cap 4, the plug hole 11 further comprises a groove 12 at the bottom; the diameter of groove 12 is smaller than the diameter of plug hole 11; said positioning plug 2 further includes two parts: one part is located in the groove 12 which is tightly fitted to said groove 12, the other part is located in the plug hole 11. Another end of line spring wire 3 is located between an external surface of the other part of the positioning plug 2 in the plug hole 11 and the interior surface of plug hole 11.

Figure 6:
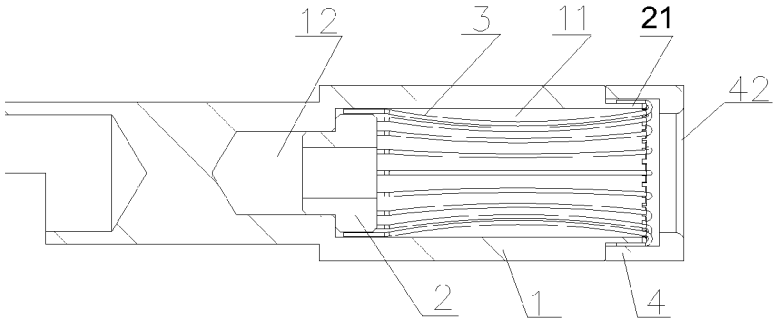
FIG. 6 shows a cross sectional view of a line spring jack according to an embodiment of the invention.
Figure 7:
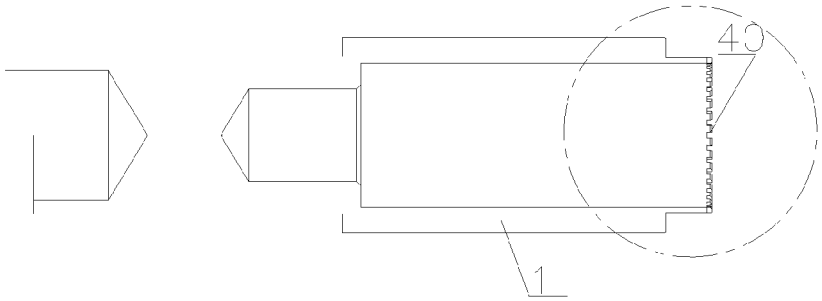
FIG. 7 shows a cross sectional view of the jack body before assembling according to an embodiment of the invention.
Figure 8:
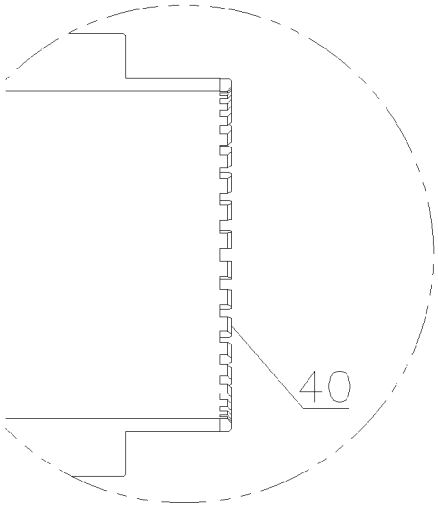
FIG. 8 shows an enlarged view indicated by a circle in FIG. 7.

In some embodiment, as shown in FIG. 6 to FIG. 8, the jack body further comprises a plurality of fixing grooves 40 ranked in the brim of the jack body with certain distance in between; said line spring wire is disposed in the fixing grooves 40; and one end of said line spring wire 3 extending out of the fixing grooves 40 is clipped in a space between said jack cap 4 and said jack body 1. There is further a space between a part of said positioning plug 2 in the plug hole 11 and the interior surface of the jack body 1; the other end of said line spring wire 3 is located in said space; said ling spring wire 3 can move relatively in the space by an outside force.

In some embodiment, the cross-section of said plug hole 11, groove 12 and through hole 42 has a round shape respectively.

In some embodiment, the cross-section of said jack body 1 and jack cap 4 are round.

In some embodiment, the line spring jack further comprises a plurality of line spring wire 3, the plurality of line spring 3 are uniformly permutated along the internal circumferential wall of the plug hole 11.

Said line spring wire 3 may be made of metal such as iron, copper etc, which is publicly known to the person normally skilled in the art.

Said positioning plug 2 further includes one part in the groove 12 and another part in the plug hole 11; the part in the groove 12 is tightly fitted with said groove 12, and the other end of the line spring wire 3 is located between the external surface of the other part in the plug hole 11 and the interior surface of the plug hole 11. The diameter of said positioning plug 2 in the plug hole 11 is greater than the diameter of the groove 12 and is smaller than the diameter of the plug hole 11. In some embodiment, said positioning plug 2 is a cylinder with two parts: the first part is tightly fitted in the groove 12; and the second part is disposed in the plug hole 11 and there is a clearance fit between the second part and said plug hole 11; the second part is also fixed in the bottom of said plug hole 11; and the other end of the line spring wire 3 is restricted in the space between said second part and the side wall of plug hole 11. The external diameter of said second part is greater than the diameter of the groove 12; the space between the second part and the side wall of the plug hole 11 is slightly greater than the external diameter of said line spring wire 3, so that the movement of the other end of the line spring wire 3 along the longitudinal direction of the plug hole 11 is not restricted by said second part and the side wall of the plug hole 11.

In some embodiment, the external diameter in one end of said jack body 1 is smaller than the external diameters in other parts of jack body 1; said jack cap 4 covers the open end of the jack body 1. One end of the line spring wire 3 bends toward the exterior surface of said jack body 1, wherein the bending part is disposed between the interior surface of jack cap 4 and the exterior surface of jack body 1 In some embodiment, the length of the exterior surface of one end of said jack body is less than the length of the interior surface of said jack cap 4. and the external diameter thereof is smaller than the external diameters in other parts of said jack body 1

In some embodiment, said fixing grooves 40 are uniformly ranked in the brim of the jack body; said line spring wire 3 is located in the fixing grooves. Through the end of the line spring wire which is in the space between the interior surface of said jack cap and the exterior surface of said jack body, the jack cap and the jack body is interference fitting with each other.

Wherein, the internal diameter of said jack cap 4 is greater than the internal diameter in one end of said jack body 1; said jack cap 4 is fixed with said jack body 1 by the line spring wire 3 which is in the space between the interior surface of said jack cap 4 and the exterior surface of said jack body 1; the end of said line wire spring 3 bending toward the exterior surface of said jack body 1 is restricted between the interior surface of said jack cap 4 and the exterior surface of said jack body 1.

In some embodiment, said jack cap 4 further comprises a flange 41 which extends toward the through hole 42. Said flange 41 is located at an end of said jack cap 4; the internal diameter 41 is not less than the external diameter of the plug stud which is matched with said line spring jack. In some embodiment, there may be a space between the inside of said flange 41 and the port of said plug hole 11; said space is slightly greater than the external diameter of said line spring wire 3.

A part of said line spring wire 3 curves toward the axial direction of said plug hole 11, so that the spring wire 3 can tightly touch said plug stud when the plug stud(not shown) is plugged into the plug hole 11.

There is further a space between another end of said line spring wire 3 and the bottom of said plug hole 11. When the plug stud fitted with said line spring jack is inserted into said plug hole 11; the curved part of the ling spring wire 3 is squeezed by the plug stud and the line spring wire 3 will be deformed accordingly; and the other end of said line spring wire 3 will move toward the bottom of said plug hole 11.

The line spring jack provided in the present invention further comprises a space between the second part of the positioning plug 2 and the interior surface of plug hole 11. Said space ensures that the line spring wire 3 is arranged continuously and regularly along the side wall of the plug hole 11. Meanwhile, said space ensures that the other end of the line spring wire 3 will not be deadlocked. Therefore, the insertion and/or withdrawal force reaches perfect when inserting and withdrawing the plug stud. Meanwhile, there is further a space between another end of the line spring wire 3 and the bottom of the plug hole 3, so that there is enough space for the line spring wire 3 to extend when inserting or withdrawing.

A method of assembling a line spring jack according to an embodiment of the invention is further disclosed. The method comprises: providing a jack body 1, a jack cap 4, one or more line spring wires 3 and a positioning plug 2; the jack body 1 further comprises an open end and a closed end and a plug hole 11 therein between the open end and the closed end, the plug hole 11 further including a groove 13 near the closed end of the jack body 1, the diameter of the groove 12 is smaller than the diameter of the rest of the plug hole 11; and the jack cap 4 further includes a through hole via which the plug hole 11 is exposed externally. The jack cap 4 further comprises a through hole 42 which connects with the plug hole 11;

Putting the one or more line spring wire 3 in the plug hole 11 of the jack body 1; embedding part of said positioning plug 2 into said groove 12, which divides the positioning plug 2 into two parts: one part is located in the groove 12, and the other part is located in the plug hole 11; covering said jack cap 4 over said jack body 1 tightly; one end of the line spring wire 3 is clipped in a space between the jack cap 4 and the jack body 1; putting another end of the line spring wire 3 between the external surface of the part of said positioning plug 2 in the plug hole 11 and the interior surface of the plug hole 11.

In some embodiment, the line spring wire 3 is disposed in the fixing grooves 40 ranked in the brim of the jack body. One end of said line spring wire 3 is located in the space between the part of the positioning plug in the plug hole and the interior surface of said jack body; said line spring wire can move in the space by an outside force.

In some embodiment, the diameter of said positioning plug 2 in the plug hole 11 is greater than the diameter of the groove 12 and is smaller than that of plug hole 11.

Figure 2:
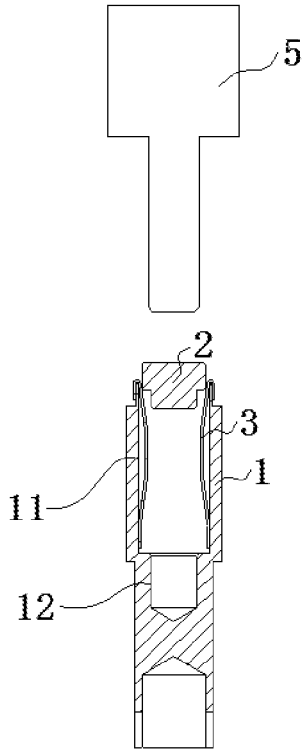
FIG. 2 shows a schematic view before assembling a positioning plug according to an embodiment of a method of assembling a line spring jack.
Figure 3:
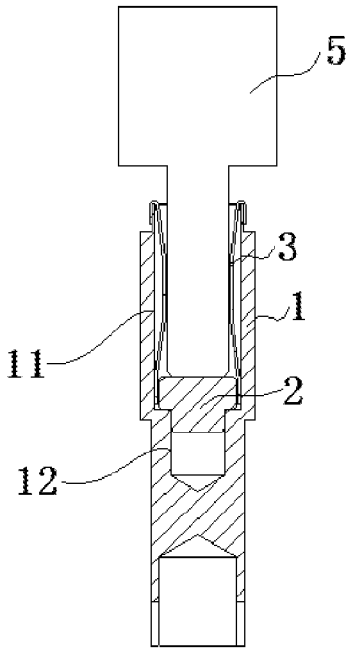
FIG. 3 shows a schematic view after assembling the positioning plug according to an embodiment of a method of assembling a line spring jack.

As shown in FIG. 2 and FIG. 3, the first part of the positioning plug 2 is aligned to said plug hole 11; an impulsive force is exerted to the second part of the positioning plug 2 by means of a punch 5; the positioning plug 2 is pushed into the plug hole 11 and the first part of the positioning plug 2 is inserted into said groove 12, so that the positioning plug 2 is fixed at the bottom of plug hole 11, and the other end of the line spring wire 3 is located between the second part of the positioning plug 2 and the interior surface of the plug hole 11.

Figure 9:
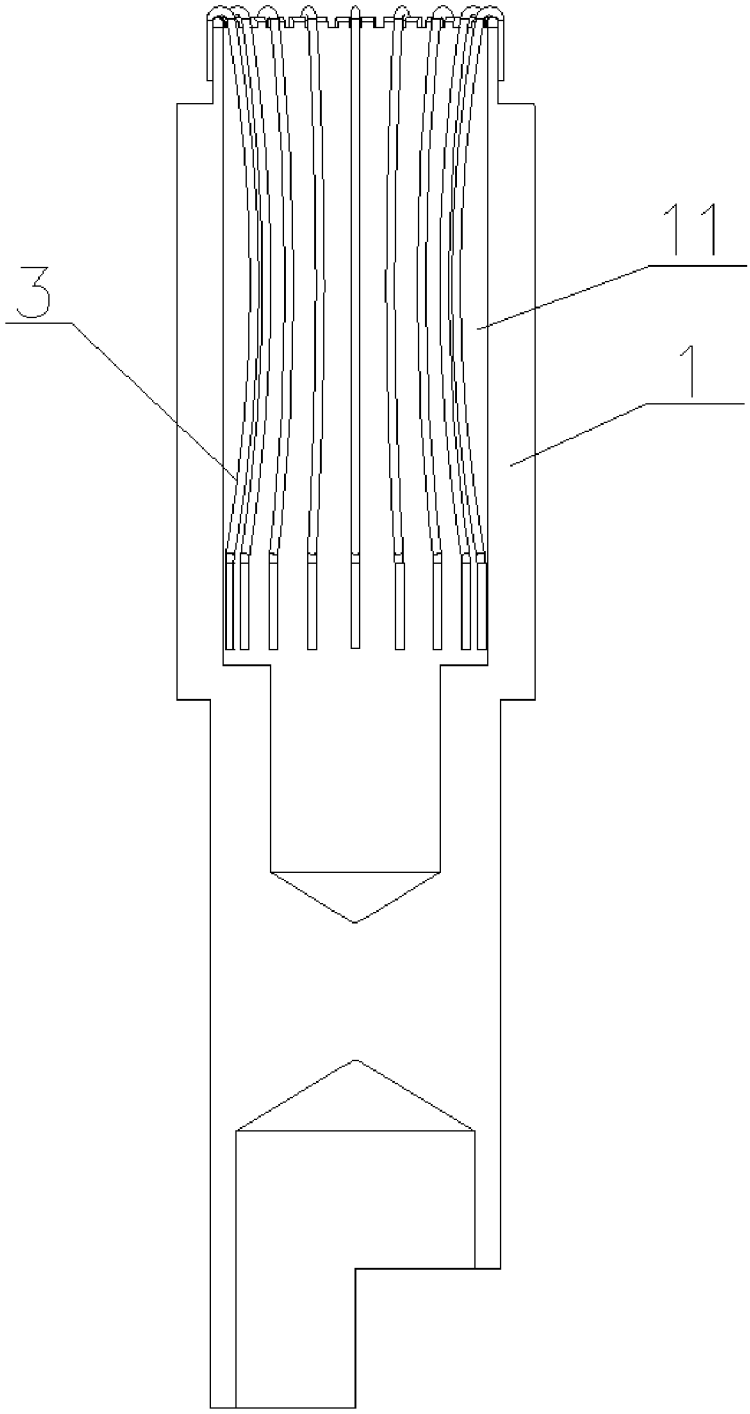
FIG. 9 shows a schematic view of a line spring wire according to an embodiment of the invention after assembling.
Figure 10:
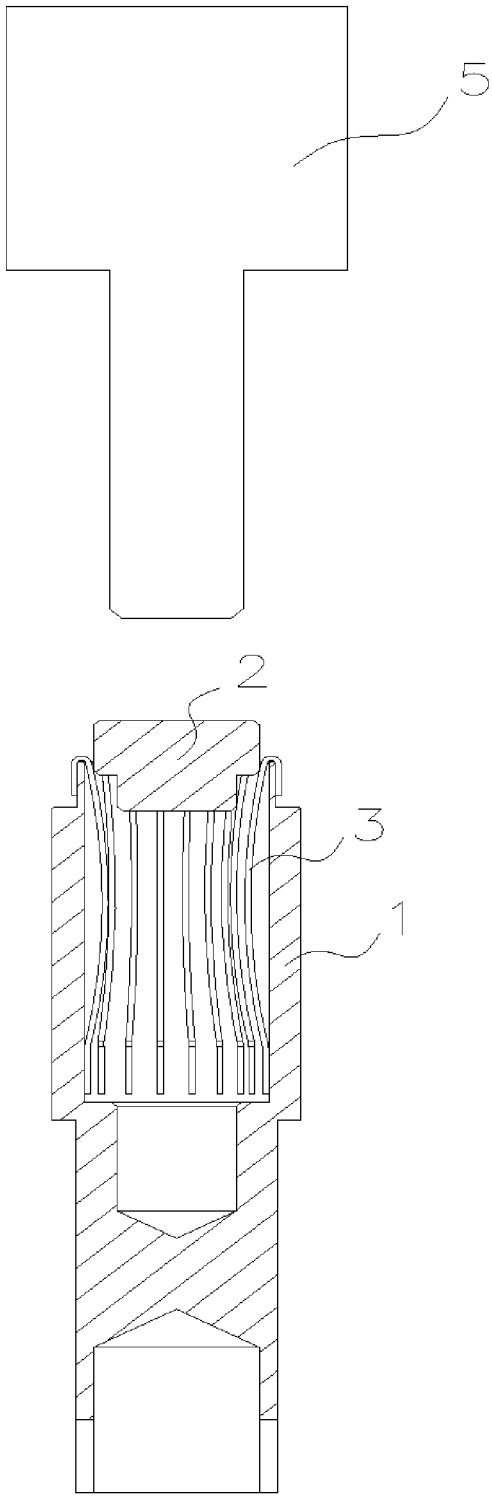
FIG. 10 shows a schematic view of a line spring wire according to an embodiment of the invention before assembling a positioning plug.

In some embodiment, as shown in FIG. 9 and FIG. 10, the line spring wire is fixed in the groove of the brim of the jack body along the interior surface of the jack body. One end of the line spring wire 3 bends toward the exterior surface of said jack body 1; there is further a space between another end of the line spring wire 3 and the bottom of the jack body 1; the first part of the positioning plug 2 is aligned to said plug hole 11; an impulsive force is exerted to the second part of the positioning plug 2 by means of a punch 5; the positioning plug 2 is pushed into the plug hole 11 and the first part of the positioning plug 2 is inserted into said groove 12, so that the positioning plug 2 is fixed at the bottom of plug hole 11, and another end of the ling spring wire 3 is located between the second part of the positioning plug 2 and the interior surface of the plug hole 11. The distance between another end of the line spring wire 3 and said positioning plug 3 is about 0.2-0.4 mm.

Further, the external diameter in one end of said jack body 1 is smaller than the external diameters in other parts of said jack body 1; the method of clipping one end of the line spring wire 3 in the space between the jack cap 4 and the jack body 1 comprises: extending one end of the line spring wire 3 out of the plug hole 11; bending a part of the line spring wire 3 that extends out of the plug hole 11 toward the exterior surface of the jack body 1; and the bent part of the line spring wire 3 is located in the open end of the jack body 1, the external diameter is smaller than the external diameters in other parts of the jack body 1; covering said the open end of the jack body 1 with said jack cap 4; the bent part of the line spring wire 3 is located between the interior surface of the jack cap 4 and the exterior surface of the jack body 1.

Figure 4:
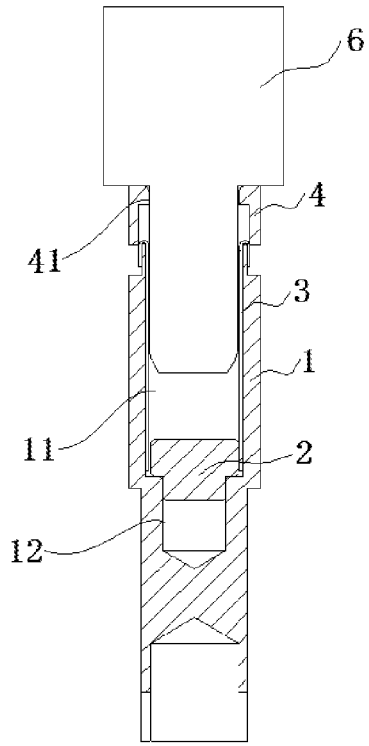
FIG. 4 shows a schematic view before assembling a jack cap according to an embodiment of a method of assembling a line spring jack.
Figure 5:
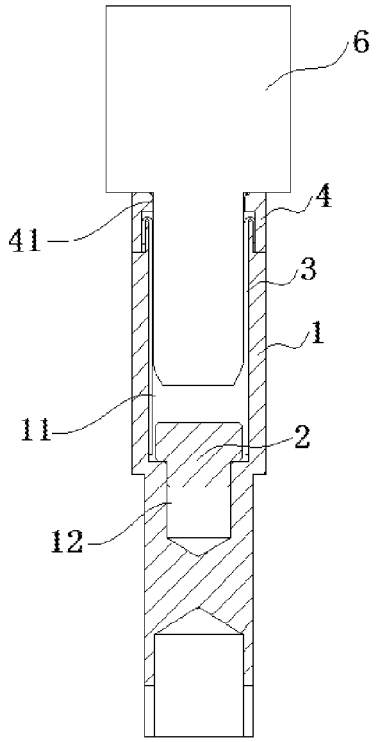
FIG. 5 shows a schematic view after assembling a jack cap according to an embodiment of a method of assembling a line spring jack.

Further, as shown in FIG. 4 and FIG. 5, the method of covering the jack body 1 with the jack cap 4 comprises: providing a punch 6 with two part cylinders; the external diameter of the first part is smaller than the internal diameter of the through hole 42 and plug hole 11; the external diameter of the second part is greater than the external diameter of said through hole 42; putting the first part into the through hole 42, and applying a force along the longitudinal direction to the second part of the punch 6, thus one end of said line spring wire 3 is clipped in the space between the interior surface of said jack cap 4 and exterior surface of the jack body 1.

In some embodiment, the external diameter of the first part of said punch 6 is the same as that of the plug stud which matches with said line spring wire; the external diameter of the second part of the punch 6 is greater than that of said jack cap 4; putting said jack cap 4 at one end of said jack body 1; the first part of said punch 6 is inserted into said plug hole 11 via the through hole 42, and the flange 41 of said jack cap 4 contacts the second part of the punch 6; exerting a force on the second part of the punch 6 along the axial direction of said cylinder; and one end of said line spring wire 3 is clipped in the space between the interior surface of said jack map 4 and the exterior surface of said jack body 1.

Before assembling said jack cap 4, the line spring wire 3 is not fixed because there is a space between the positioning plug 2 and the line spring wire 3. To avoid the overlapping and the disorder and/or distortion of the line spring wire 3 after assembling, the external diameter of the first part of said punch 6 is the same as that of the stud plug which matches with the line spring jack. The line spring wire 3 in the plug hole 11 can be arranged by the punch 6 when assembling the jack cap 4.

In some embodiment, the flange 41 of said jack cap 4 extends inwardly towards the through hole 42.

In some embodiment, a part of said line spring wire 3 is curved inwardly in a direction perpendicular to the longitudinal direction of said plug hole 11.

In some embodiment, there is further a space between another end of said line spring wire 3 and the bottom of said plug hole 11.

In some embodiment, the space between part of the positioning plug 2 in the plug hole 11 and the interior surface of the plug hole 11 is greater than the external diameter of said line spring wire 3.

In some embodiment, the line spring jack further may comprise a plurality of line spring wire 3. The plurality of line spring wire 3 are permutated regularly along the circumferential interior surface of the plug hole 11.

The assembly method of the present invention is simple and easy to implement, and has no further higher requirement for the assembly tools.

What is claimed is:

1. A line spring jack comprising:

a jack body having an open end and a closed end and a plug hole therein between the open end and the closed end, said plug hole further including a groove near the closed end of said jack body, wherein the diameter of the groove is smaller than the diameter of the rest of said plug hole;

a jack cap connected to the open end of the jack body, said jack cap further including a through hole via which said plug hole is exposed externally;

one or more line spring wires within the plug hole; and a positioning plug within the plug hole, said positioning plug further including a first portion within the groove and a second portion within the rest of said plug hole, wherein the first portion within the groove is configured to tightly fit said groove;

wherein:

a first end of at least one of said one or more line spring wires is located within a space defined between an interior surface of said jack cap and an exterior surface of said jack body; and a second end of the at least one line spring wire is located within a space defined between an exterior surface of the second portion of the plug hole and an interior surface of the jack body.

2. The line spring jack according to claim 1, wherein the diameter of the second portion of said positioning plug within the rest of said plug hole is greater than the diameter of the groove and smaller than the diameter of the rest of said plug hole.

3. The line spring jack according to claim 1, wherein the external diameter near the closed end of said jack body is smaller than the external diameter near the open end of said jack body at which end said jack cap is jacketed; and the first end of the at least one line spring wire is configured to bend toward the exterior surface of said jack body near the open end, and the bent portion of the at least one line spring wire is between the interior surface of the jack cap and the exterior surface of the jack body near the open end.

4. The line spring jack according to claim 1, wherein said jack cap has a flange that is configured to extend toward the through hole of the jack cap.

5. The line spring jack according to claim 1, wherein at least a portion of said a least one line spring wire is configured to extend inward in a longitudinal direction of said plug hole.

6. The line spring jack according to claim 5, wherein the second end of the at least one line spring wire end of said line spring wire is separated from a transition between said plug hole and said groove by a predetermined distance.

7. The line spring jack according to claim 1, wherein the space defined between the exterior surface of the second portion of the plug hole and the interior surface of the jack body is equal to or greater than the diameter of the at least one line spring wire.

8. The line spring jack according to claim 1, wherein the jack body further includes a plurality of fixing grooves placed on the interior surface of the jack body at a predetermined interval between two adjacent fixing grooves and each of said one or more line spring wires is located within one of the fixing grooves.

9. The ling spring jack according to claim 8, wherein the second end of each of said one or more line spring wires is within the space between the exterior surface of the second portion of the plug hole and the interior surface of the jack body and said line spring wire is configured to move within the space in response to an external force applied to the line spring wire.

10. The line spring jack according to claim 8, wherein said plurality of fixing grooves are uniformly placed on the interior surface of the jack body.

11. The line spring jack according to claim 8, wherein the jack body is configured to engage the jack cap with an interference fit using the first end of the at least one line spring wire.

12. A method of assembling a line spring jack, comprising:

providing a jack body, a jack cap, one or more ling spring wires, and a positioning plug, wherein:

said jack body further includes an open end and a closed end and a plug hole therein between the open end and the closed end, said plug hole further including a groove near the closed end of said jack body, wherein the diameter of the groove is smaller than the diameter of the rest of said plug hole; and said jack cap further includes a through hole via which said plug hole is exposed externally;

placing the one or more line spring wires within the plug hole of the jack body;

placing a first portion of said positioning plug within said groove and a second potion of the positioning plug within the rest of said plug hole;

fixing said jack cap to said jack body near the open end such that a first end of the one or more line spring wires is located within a space between an interior surface of the jack cap and an exterior surface of the jack body; and placing a second end of the one or more line spring wires between an exterior surface of the second portion of said positioning plug located within the plug hole and an interior surface of the jack body.

13. The assembly method according to claim 12, wherein the diameter of said positioning plug located within the rest of said plug hole is greater than the diameter of the groove and smaller than the diameter of the rest of said plug hole.

14. The assembly method according to claim 12, wherein the external diameter near the closed end of said jack body is smaller than the external diameter near the open end of said jack body, further comprising:

pushing the first end of the one or more line spring wires outside the plug hole;

bending at least a portion of the first end of the one or more line spring wires outside the plug hole outward near the open end of the jack body, wherein the external diameter of said open end of the jack body is smaller than the diameter of said jack cap; and covering said open end of the jack body with said jack cap such that the bent portion of the one or more line spring wires is located between the interior surface of the jack cap and the exterior surface of the jack body.

15. The assembly method according claim 12, wherein there is a space between the second end of said one or more line spring wires and a transition of said plug hole near the groove.

16. The assembly method according to claim 15, further comprising:

providing a punch, the punch having a first portion whose external diameter is smaller than the diameters of the through hole and the plug hole and a second portion whose external diameter is greater than the external diameter of said through hole;

pushing the first portion of the punch into the through hole by applying a force on the second portion of the punch along a longitudinal direction of the punch; and inserting the second end of said one or more line spring wires into the space between the interior surface of said jack cap and the exterior surface of said jack body.

* * * * *